US008714209B2

(12) United States Patent
Härtel

(10) Patent No.: US 8,714,209 B2
(45) Date of Patent: May 6, 2014

(54) FILLING ELEMENT AND FILLING MACHINE FOR FILLING BOTTLES OR SIMILAR CONTAINERS

(75) Inventor: Manfred Härtel, Bretzenheim (DE)

(73) Assignee: KHS GmbH, Dortmund (DE)

( * ) Notice: Subject to any disclaimer, the term of this patent is extended or adjusted under 35 U.S.C. 154(b) by 0 days.

(21) Appl. No.: 13/639,566

(22) PCT Filed: Apr. 8, 2011

(86) PCT No.: PCT/EP2011/001753
§ 371 (c)(1),
(2), (4) Date: Oct. 5, 2012

(87) PCT Pub. No.: WO2011/154067
PCT Pub. Date: Dec. 15, 2011

(65) Prior Publication Data

US 2013/0074984 A1 Mar. 28, 2013

(30) Foreign Application Priority Data

Jun. 7, 2010 (DE) ..... 10 2010 022 874

(51) Int. Cl.
*B67C 3/26* (2006.01)
*B67C 3/06* (2006.01)

(52) U.S. Cl.
CPC ..... *B67C 3/06* (2013.01); *B67C 2003/2651* (2013.01)
USPC ..... 141/48; 141/6; 141/57; 141/47

(58) Field of Classification Search
USPC ..... 141/4–6, 37, 47, 48, 95, 57
See application file for complete search history.

(56) References Cited

U.S. PATENT DOCUMENTS

| | | | | | |
|---|---|---|---|---|---|
| 3,175,591 | A | * | 3/1965 | Manas | 141/295 |
| 3,182,691 | A | * | 5/1965 | Vergobbi et al. | 141/5 |
| 3,626,996 | A | * | 12/1971 | Bingham et al. | 141/5 |
| 3,756,290 | A | * | 9/1973 | Cleland et al. | 141/5 |
| 3,807,463 | A | * | 4/1974 | Rademacher et al. | 141/62 |
| 4,086,943 | A | * | 5/1978 | Fernandez | 141/39 |
| 4,524,563 | A | * | 6/1985 | Sassi | 53/426 |
| 5,501,253 | A | * | 3/1996 | Weiss | 141/40 |
| 5,860,459 | A | * | 1/1999 | Reed et al. | 141/198 |

(Continued)

FOREIGN PATENT DOCUMENTS

| | | |
|---|---|---|
| DE | 93 11 427 | 9/1994 |
| EP | 0 601 514 | 6/1994 |
| WO | WO 2007/016960 | 2/2007 |
| WO | WO 2007/094049 | 8/2007 |

*Primary Examiner* — Timothy L Maust
*Assistant Examiner* — Robert Bell, III
(74) *Attorney, Agent, or Firm* — Occhiuti & Rohlicek LLP

(57) ABSTRACT

Filling element for filling bottles or similar containers with a liquid filler, comprising a liquid channel which is formed in a filling-element housing and which has a connection for delivery of the liquid filler into the liquid channel and has a discharge opening for discharging the liquid filler into a container that is to be filled, and comprising at least one liquid valve, which is arranged in the liquid channel and controls the discharging of the liquid filler, said liquid valve having a valve body provided on a gas tube that can be moved in a controlled manner in a filling-element axis in order to open and close the liquid valve and that acts as valve plunger.

11 Claims, 3 Drawing Sheets

(56) References Cited

U.S. PATENT DOCUMENTS 6,457,495 B1 * 10/2002 Meheen ..... 141/40
7,730,912 B2 * 6/2010 Blichmann ..... 141/264
8,490,659 B2 * 7/2013 Laguzzi ..... 141/57

* cited by examiner

FILLING ELEMENT AND FILLING MACHINE FOR FILLING BOTTLES OR SIMILAR CONTAINERS

CROSS REFERENCE TO RELATED APPLICATION

This application is the national phase under 35 USC 371 of international application no. PCT/EP2011/001753, filed Apr. 8, 2011, which claims the benefit of the priority date of German application no. 10 2010 022 874.5, filed Jun. 7, 2010. The contents of the aforementioned applications are incorporated herein in their entirety.

FIELD OF DISCLOSURE

The invention relates to a filling element.

BACKGROUND

Filling elements for filling bottles or similar containers, in particular also for the pressure filling or counterpressure filling of containers, are known in various designs.

One disadvantage of these known filling elements is, inter alia, that the liquid charge during the filling process generally flows towards the respective filling element or the liquid channel thereof in a direction of flow that is radial to a vertical filling element axis, and the direction of flow of the charge is deflected through 90° or approximately 90° after entering the liquid channel of the filling element, which generally leads to not inconsiderable turbulence within the charge. The charge then flows within the liquid channel over an initially relatively large flow cross-section towards the open liquid valve on the filling element, at which the flow cross-section suddenly or abruptly narrows due to the enlarged cross-section of a valve body there, which again leads to turbulence and to a reduction in the flow rate of the charge towards the respective container and in particular prevents the formation of a homogeneous, uniform flow of the charge, which has a negative effect inter alia on the performance of a filling system or filling machine (number of filled containers per unit time).

Specifically in the case of pressure-filling containers with a $CO_2$-containing liquid charge, for example with beer, the situation moreover cannot be reliably avoided whereby, at the end of the respective filling process and of the pressure release to atmospheric pressure which takes place at that point and which partially takes place via a gas channel (return gas channel), a foaming of the charge and an associated rising of the foamed charge into this gas channel occurs. Due to the relatively small cross-section of the gas channel on known filling elements, in particular including on those having a probe which extends through the gas channel and which determines the filling level of the charge in the container, there is a considerable risk that even the penetration of very small quantities of the foamed charge into the gas channel will lead not only to contamination in this channel but also in adjoining gas spaces, gas channels or valves formed in the filling element.

SUMMARY

The object of the invention is to provide a filling element which avoids the aforementioned disadvantages, ensures in particular the formation of a harmonious, uniform flow of the charge through the liquid channel when the liquid valve is open and/or avoids the penetration of foamed charge into critical areas of the gas channel and adjoining gas spaces and/or channels of the filling element.

One special feature of the invention lies in the fact that the liquid channel has, in a liquid channel portion upstream of the liquid valve and extending over a large part of the liquid channel, a constant or substantially constant flow cross-section, namely a flow cross-section which corresponds substantially to the flow cross-section in the region of the valve body, so that abrupt changes in the flow cross-section on the valve body are avoided and a homogeneous, uniform flow of the charge can form in said liquid channel portion when the liquid valve is open.

The further special feature of the invention lies in the fact that the gas tube (return gas tube), in a gas channel portion adjacent to the liquid valve or the valve body thereof but upstream of the valve body relative to the direction of flow of the charge in the liquid channel, is widened in terms of the internal cross-section and thus also in terms of the flow cross-section, namely in particular in comparison to the cross-section of the gas tube at its lower, open gas tube end. At the end of the respective filling process, any charge foam rising in the gas tube can thus be accommodated in this widened gas tube portion and thus does not enter critical areas of the gas channel and adjoining gas spaces and/or channels of the filling element.

In the context of the invention, the expression "substantially" means deviations of +/−10%, preferably of +/−5%, from the respective exact value.

Further developments, advantages and possible uses of the invention will also become apparent from the following description of examples of embodiments and from the figures. All the features described and/or shown form in principle, per se or in any combination, the subject matter of the invention, regardless of the way in which they are combined in the claims or the way in which they refer back to one another. The content of the claims is also included as part of the description.

BRIEF DESCRIPTION OF THE FIGURES

The invention will be explained in more detail below with reference to the figures and on the basis of an example of embodiment. In the figures.

DETAILED DESCRIPTION

Figure 1:
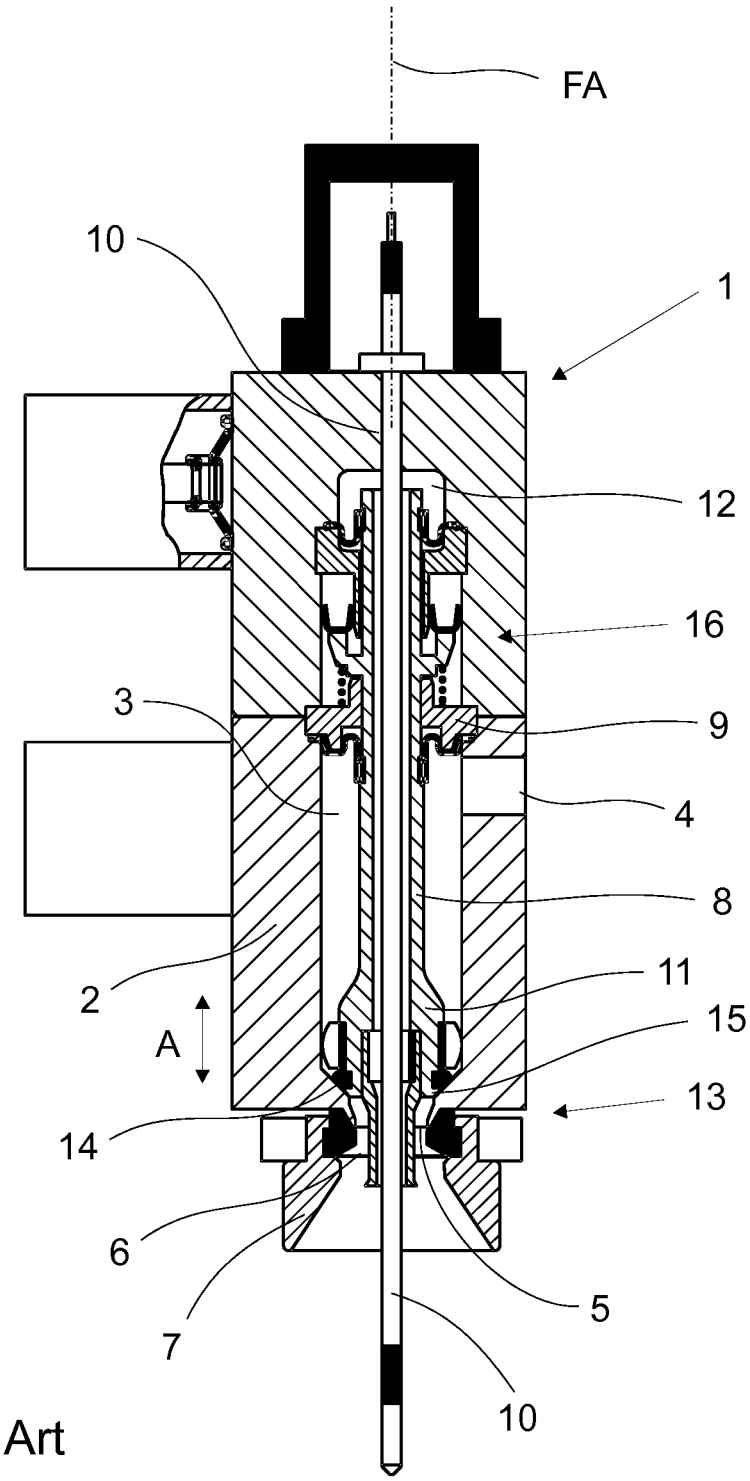
Prior Art Fig. 1
FIG. 1 shows, in a simplified partial view and in section, a filling element of the conventional type for filling containers or bottles with a liquid product or charge, comprising a probe which determines the filling level.

The filling valve shown in FIG. 1 and denoted generally therein by 1 is part of a filling system which comprises a plurality of such valves, for example the filling system of a filling machine of the rotary type, in which the filling elements 1 are then provided, in the manner known to the person skilled in the art, on the circumference of a rotor which can be driven in rotation about a vertical machine axis. The filling element 1 comprises inter alia a multi-part filling element housing 2, in which there is formed a liquid channel 3 for the liquid charge, which liquid channel is connected in the region of its upper end via a connection or inlet 4 to a line or a vessel for feeding the liquid charge and forms in the region of its lower end or on the underside of the filling element housing 2 an annular discharge opening 5 which concentrically surrounds a vertical filling element axis FA, via which discharge opening the liquid charge flows towards the respective container during the filling process. During the filling (pressure filling) process, the respective container is located in a sealed position against the filling element 1, i.e. it bears with the mouth edge or bead surrounding its container mouth against a seal 6 provided on the underside of the filling element housing, which seal annularly surrounds the discharge opening 5 and in the illustrated embodiment is part of a centring bell 7 for centring the respective container relative to the filling element 1.

Provided coaxial to the filling element axis FA is a gas tube 8 which protrudes downwards with its lower, open end beyond the discharge opening and the annular seal 6, extends with a partial length through the liquid channel 3 and is passed out of the liquid channel 3 at the top of the liquid channel 8 in a manner sealed by means of a seal 9 that is configured for example as a membrane.

Also provided coaxial to the filling element axis FA is a rod-shaped probe 10 which determines the filling level during the filling of the respective container, extends through the gas tube 8 and protrudes with its lower probe end out of the lower, open end of the gas tube 8, namely so as to form within the gas tube 8 an annular gas channel 11 (return gas channel) surrounding the probe 10. This gas channel 11 is open at the lower end of the gas tube 8 and opens at the upper end of the gas tube 8 into a chamber 12 which, like the gas channel 11, forms part of gas paths of the filling element 1 that control the respective filling process, as likewise known to the person skilled in the art.

Provided in the liquid channel 3 is a liquid valve 13 which, for the controlled discharging of the liquid charge, is opened and closed as a function also of the signal from the probe 10. For the liquid valve 13, the gas tube 8 is configured over a relatively short lower partial length, which is accommodated in the liquid channel 3, as a valve body 14 which cooperates with a valve seat 15 on the inside of the liquid channel 3. In order to open and close the liquid valve 13, the gas tube 8 can be moved up and down (double-headed arrow A) in a controlled way in the manner of a valve plunger in the direction of the axis FA by means of an actuating device 16 which is for example a pneumatic actuating device.

The filling of the respective container by the filling element 1 takes place by means of a filling method known to the person skilled in the art, for example a pressure filling or counterpressure filling method, in which the container located in a sealed position against the filling element is preloaded—for example after preliminary evacuation and flushing with inert gas ($CO_2$ gas)—then filled under pressure and, at the end of the filling process, the pressure is at least partially released via the gas channel 11 until ambient pressure is reached.

The charge flowing into the liquid channel 3 via the connection 4 during the filling process undergoes immediately thereafter a change in the direction of flow through 90°. In addition, the flow cross-section of the liquid channel 3 narrows relatively abruptly in the region of the valve body 14 of the open liquid valve, which leads to considerable turbulence within the charge and prevents the formation of a homogeneous, uniform flow of the charge through the liquid channel 3 to the discharge opening 5. As a result, the performance (filled containers per unit time) of a filling machine equipped with the filling elements 1 is in particular also greatly reduced.

When filling the containers with a $CO_2$-containing charge, for example beer, the situation cannot be avoided whereby a foaming of the charge occurs in the pressure release phase at the end of the respective filling process and foam thereby enters the gas channel 11. One disadvantage of the filling element 1 is that the annular gas channel 11 has a relatively small flow cross-section, so that the foamed charge possibly completely fills the gas channel 11 over its entire length and may even pass into the chamber 12 and possibly into further gas paths adjoining this chamber, and thus undesirable contamination occurs within the filling element and the gas paths therein. If an evacuation of the container located respectively in the sealed position against the filling element takes place via the gas channel 11 at the start of a filling process, then foamed charge residues present in the gas channel 11 are sucked off, as a result of which considerable product losses may occur.

Figure 2:
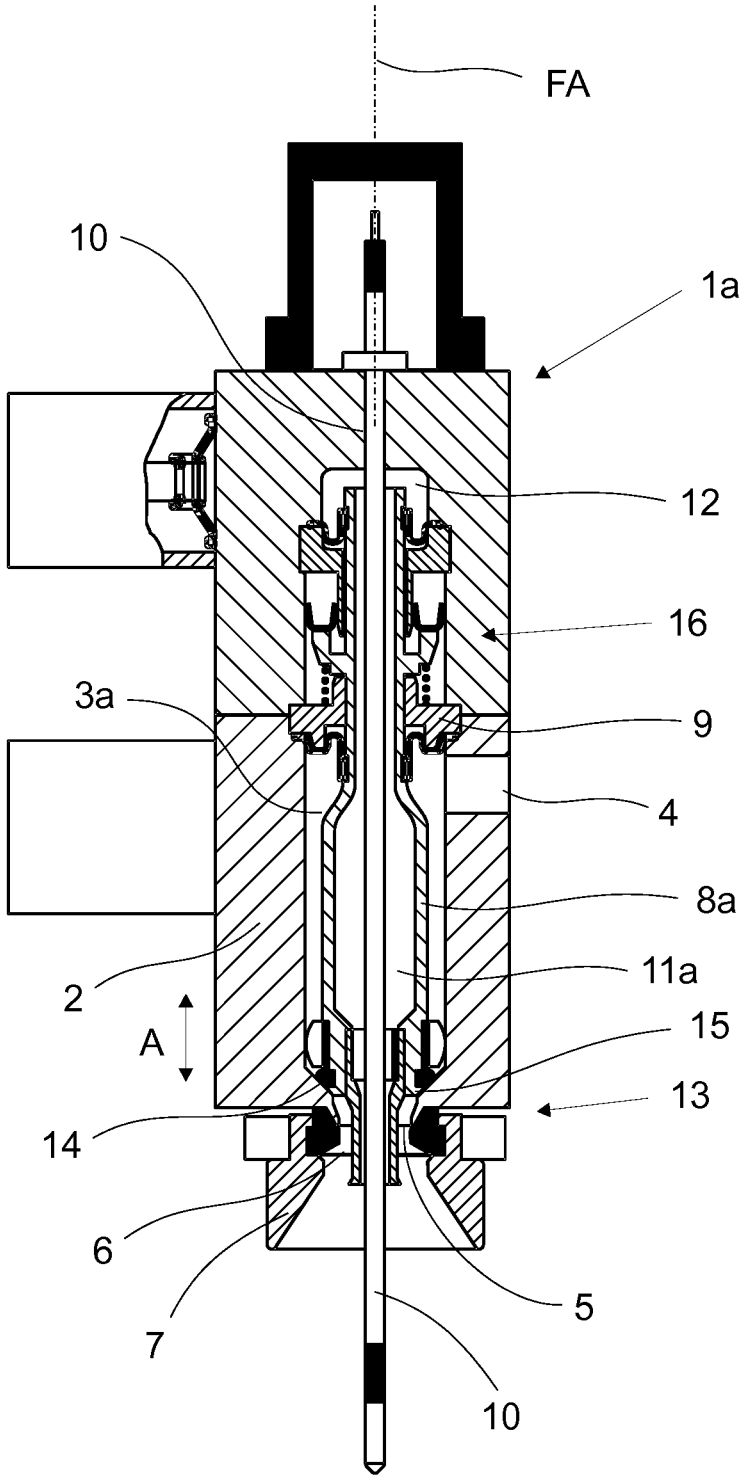
FIG. 2 shows, in a diagram similar to FIG. 1, a filling element according to the invention.
Figure 3:
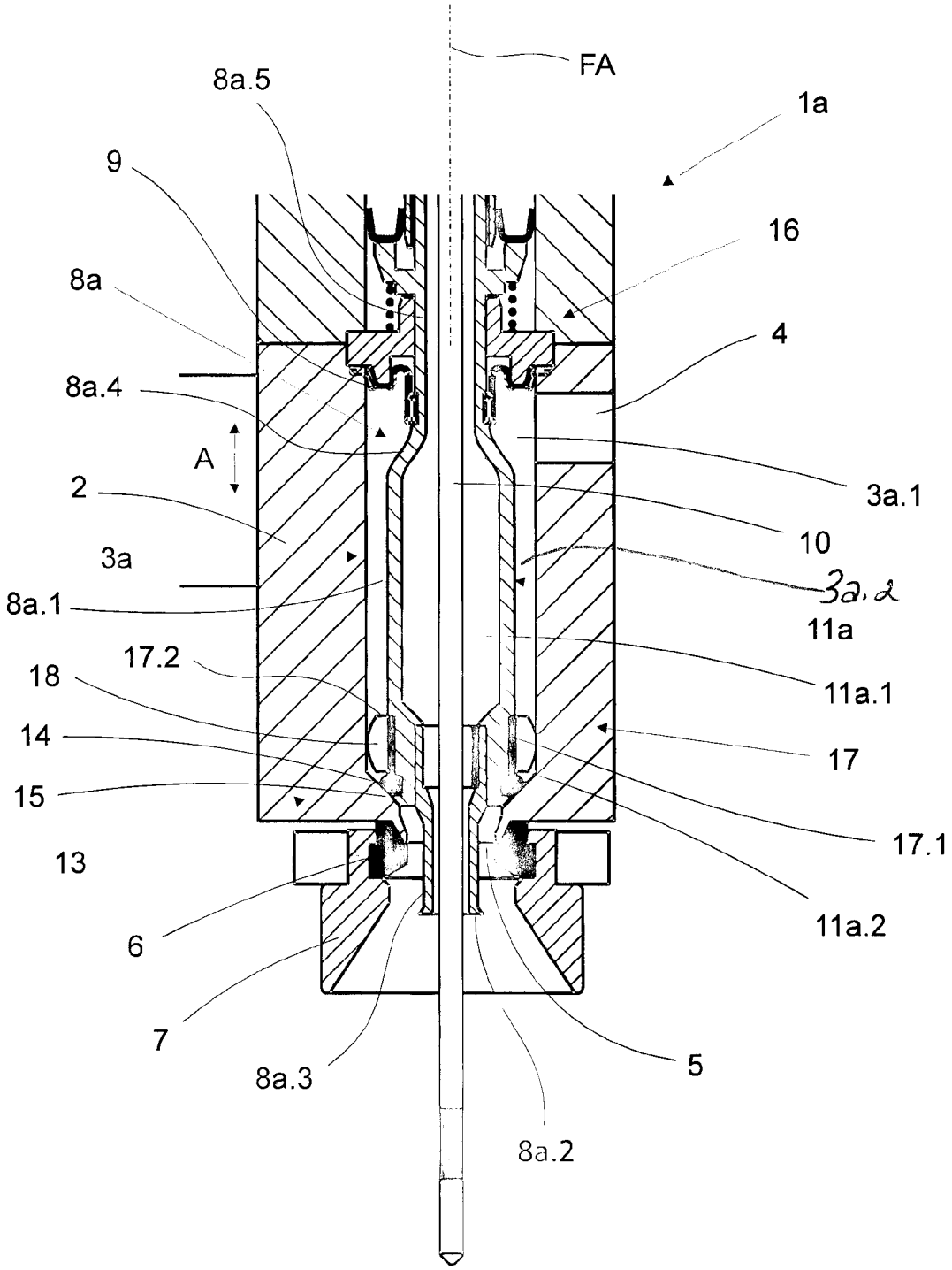
FIG. 3 shows an enlarged partial section through the filling element of FIG. 2.

FIGS. 2 and 3 show a filling element la according to the invention, which in terms of its basic structure, its use and function and also the function of its individual elements is identical to the filling element 1, apart from the differences described below. Those elements of the filling element la which correspond in terms of their function and/or design to the elements of the filling element 1 are therefore denoted in FIGS. 2 and 3 by the same reference numbers as in FIG. 1. Those elements which differ from those of FIG. 1 are in each case provided with the index "a" in FIGS. 2 and 3.

One significant difference of the filling element 1*a* lies in the fact that the gas tube, denoted by 8*a* in FIGS. 2 and 3, is configured with an enlarged external and internal diameter in the gas tube portion 8*a*.1 running in the liquid channel 3 and adjoining the valve body 14 in the direction of the top of the filling element, i.e. counter to the direction of flow of the charge, namely such that the gas channel, which is denoted by 11*a* in FIGS. 2 and 3 and corresponds otherwise in terms of its design and function to the gas channel 11, has almost over the entire partial length extending through the liquid channel 3 in the direction of the filling element axis FA a gas channel portion 11*a*.1 shaped in the manner of an annular channel or ring and having a considerably enlarged cross-section, in particular having a cross-section that is considerably enlarged in comparison to the flow cross-section of the rest of the gas channel 11*a* and the opening of the gas channel 11*a* at the lower gas tube end 8*a*.2. In particular, the flow cross-section in the gas channel portion 11*a*.1 is a multiple larger, for example 4 to 6 times larger, than the flow cross-section in the gas tube portion 8*a*.3 forming the gas tube end 8*a*.2 and in the gas tube portion 8*a*.4 which adjoins the gas tube portion 8*a*.1 at the top via the gas tube portion 8*a*.5 of decreasing external and internal diameter. Within the valve body 14, too, the gas channel 11*a* is configured with an annular gas channel portion 11*a*.2 of enlarged flow cross-section. In the illustrated embodiment, the internal diameter of the gas tube 8*a* and thus the flow cross-section of the gas channel 11*a* in the region of the gas channel portion 11*a*.1 are nevertheless larger than in the gas channel portion 11*a*.2.

In the illustrated embodiment, in which the gas tube 8*a* has a circular internal and external diameter and the probe 10 has a circular external cross-section, in the gas channel portion 11*a*.1 the internal diameter of the gas tube 8*a* is approximately 2.5 to 4.0 times, preferably 3.5 times, the external diameter of the probe 10 and in the gas channel portion 11*a* the internal diameter of the gas tube 8*a* is approximately 2 to 3 times the external diameter of the probe 10.

In the illustrated embodiment, the axial length of the gas channel portion 11*a*.1 is at least 40%, preferably at least 50%-60%, of that partial length of the gas tube 8*a* which is accommodated in the liquid channel denoted by 3*a* in FIGS.

2 and 3, said liquid channel corresponding in terms of its function to the liquid channel 3 of the filling element 1.

Due to the described design of the gas tube 8*a*, the liquid channel 3 forms at the inlet 4 firstly a liquid channel portion 3*a*.1 which narrows in the direction of flow of the charge and surrounds the gas tube portion 8*a*.5 in an annular manner, then has a constant flow cross-section in a liquid channel portion 3*a*.2 which surrounds the gas tube portion 8*a*.1 in an annular manner, and the cross-section of the liquid channel 3*a* narrows only in the lower region to form the valve seat 15. An abrupt narrowing of the flow cross-section in the region of the valve body 14 is avoided in the case of the filling element 1*a*.

The liquid channel portion 3*a*.2 extends over most of the total length of the liquid channel 3*a*, for example in the illustrated embodiment over at least 50% or 60% of the total length of the liquid channel 3*a* which is formed between the top seal 9 and the discharge opening 5. In the illustrated embodiment, the external cross-section of the annular liquid channel 3*a* in the region of the liquid channel portion 3*a*.2 is approximately 1.3 to 1.5 times the external cross-section of the gas tube 8*a*.

The valve body 14 is provided on its circumference with a guiding and swirl-creating body 17 which forms at least one flow channel 18 that surrounds the filling element axis FA in the manner of a coil. Said flow channel is connected on one side to the flow channel portion 3*a*.2 and on the other side, when the liquid valve 13 is open, to the discharge opening 5 and is delimited in the circumferential direction by the inner face of the liquid channel 3*a*, inwardly by an annular portion 17.1 of the swirl-creating body 17 and axially by at least two wall portions 17.2 protruding beyond the outer face of this portion 17.1 and surrounding the filling element axis FA in the manner of a coil. In the illustrated embodiment, the external diameter of the annular portion 17.1 is equal to or approximately equal to the external diameter of the gas tube 8 in the region of the gas tube portion 8*a*.1.

The filling element 1*a* therefore comprises, inter alia, the following elements:

| | |
|---|---|
| filling element housing 2 | discharge opening 5 |
| liquid channel 3a | seal 6 |
| liquid channel portions 3a.1/3a.2 | centring bell 7 |
| inlet 4 | gas tube 8a |
| gas tube portion 8a.1/8a.2 | liquid valve 13 |
| seal 9 | valve body 14 |
| probe 10 | valve seat 15 |
| gas channel 11a | actuating device 16 |
| gas channel portion 11a.1/11a.2 | swirl-creating body 17 |
| chamber 12 | flow channel 18. |

The filling of the respective container by the filling element 1*a* likewise takes place by means of a filling method known to the person skilled in the art, in particular by means of a pressure filling or counterpressure filling method, in which the container located in a sealed position against the filling element is preloaded—for example after preliminary evacuation and flushing with inert gas ($CO_2$ gas)—then filled under pressure and, at the end of the filling process, the pressure is at least partially released via the gas channel 11*a* until ambient pressure is reached.

The particular advantage of the filling element 1*a* lies in the fact that abrupt changes in the flow cross-section in the liquid channel 3*a* are avoided, even in the region of the valve body 14, and a homogeneous flow or an improved flow vector of the flow of charge can be obtained during filling in the liquid channel portion 3*a*.2 which is relatively long in relation to the total length of the liquid channel 3*a* and which has a constant or substantially constant flow cross-section, thus ultimately leading to an increased performance of a filling system equipped with the filling elements 1*a* or of a corresponding filling machine.

Another significant advantage of the filling element la lies in the fact that the gas channel 11*a* has an enlarged cross-section next to the valve body 14 in the gas channel portion 11*a*.1 over a relatively large axial length, and thereby forms a sufficiently large volume for accommodating any product foam or charge foam rising in the gas channel 11*a* at the end of the filling process, so that said foam does not pass into critical areas of the gas paths on the filling element, i.e. into the upper region of the gas channel 11*a* and/or into the chamber 12 and/or into gas channels adjoining the latter. Contamination of the filling element 1*a* is thus prevented.

Furthermore, the design of the filling element 1*a* also has the advantage that any charge entering the lower regions of the gas channel 11*a* and thereby for example the gas channel portion 11*a*.1 due to foam formation can flow off more easily into the relevant container at the end of the respective filling process so that, even in the case of filling methods with preliminary evacuation of the respective container, less charge enters a vacuum channel of the filling system which creates the vacuum for the preliminary evacuation.

The invention has been described above on the basis of an example of embodiment. It will be understood that numerous changes and modifications are possible without thereby departing from the inventive concept on which the invention is based. For instance, the invention is of course not limited to filling elements or filling systems with probes which determine the filling level, but rather includes inter alia also filling elements and filling systems in which the quantity of charge introduced into the respective container is controlled in some other way, for example by measuring the inflowing quantity of charge and/or by detecting the weight of the respective container during filling. Furthermore, the filling element according to the invention is suitable both for pressure or counterpressure filling and for pressureless filling of containers.

List of references

| | |
|---|---|
| 1, 1a | filling element |
| 2 | filling element housing |
| 3, 3a | liquid channel |
| 3a.1, 3a.2 | liquid channel portion |
| 4 | connection or inlet |
| 5 | discharge opening |
| 6 | seal |
| 7 | centring bell |
| 8, 8a | gas tube |
| 8a.1, 8a.3 | portion of the gas tube 8a |
| 8a.4, 8a.5 | portion of the gas tube 8a |
| 8a.2 | lower gas tube end |
| 9 | seal |
| 10 | probe |
| 11, 11a | gas channel |
| 11a.1, 11a.2 | gas channel portion |
| 12 | chamber |
| 13 | liquid valve |
| 14 | valve body |
| 15 | valve seat |
| 16 | actuating device |
| 17 | swirl-creating body |
| 17.1, 17.2 | portion of the swirl-creating body 17 |
| 18 | flow channel |
| A | stroke of the valve body 14 |
| FA | filling element axis |

The invention claimed is:

1. An apparatus comprising a filling element for pressure filling a container with a liquid product, said filling element extending along a filling element axis and comprising a liquid channel formed in a filling element housing, said liquid channel comprising an inlet for feeding said liquid product into said liquid channel along a radially inward direction relative to said filling element axis, and a discharge opening for discharging said liquid product into said container, a liquid valve arranged in said liquid channel, said liquid valve comprising a valve body and being arranged in said liquid channel for controlling discharge of said liquid product into said container, and a gas tube radially symmetric about said filling element axis, said gas tube being surrounded by said valve body and configured to act as a valve plunger, said gas tube being movable in a controlled manner along said filling-element axis to open and close said liquid valve, wherein said gas tube comprises during a filling process and having a partial length extending through said liquid channel, wherein said gas tube comprises, adjacent to said valve body and over at least half of said partial length, a first gas tube portion having an enlarged external cross-section, said enlarged external cross-section being substantially equal to an external cross-section of one of said valve body and a wall portion that delimits, in a radially inward direction relative to said filling element axis, a flow path surrounding said valve body, said first gas tube portion extending between a second gas tube portion and a third gas tube portion, said second and third gas tube portions having an external cross section that is smaller than said enlarged external cross section, wherein said liquid channel forms, at least over said partial length extending in said direction of said filling element axis, a first liquid channel portion that surrounds said first gas tube portion to form an annular channel that has a substantially constant flow cross-section, wherein said first liquid channel portion extends over at least 50% of one of said partial length and total length of said liquid channel.

2. The apparatus of claim 1, wherein said gas tube comprises, on said first gas tube portion, an enlarged internal cross-section forming a gas channel portion having one of an enlarged flow cross-section and an enlarged volume.

3. The apparatus of claim 2, further comprising a probe arranged coaxial to said filling element axis, said probe extending through said gas tube in such a way that said gas channel and gas channel portions thereof are each formed to surround said probe to define one of an annular channel and a ring.

4. The apparatus of claim 1, wherein said first gas tube portion comprises an enlarged internal and external cross-section.

5. The apparatus of claim 1, wherein said liquid channel comprises, upstream of said first liquid channel portion and in said direction of flow of said charge, a second liquid channel portion that surrounds said gas tube to define of one of an annular channel and a ring and that has a cross-section that narrows in said direction of flow, wherein said second liquid channel portion comprises, in said direction of said filling element axis, an axial length that is smaller than an axial length of said first liquid channel portion.

6. The apparatus of claim 1, wherein said liquid channel comprises, upstream of said first liquid channel portion and in said direction of flow of said liquid product, a second liquid channel portion that surrounds said gas tube to define one of an annular channel and a ring and that has a cross-section that narrows in said direction of flow, wherein said second liquid channel portion comprises, in said direction of said filling element axis, an axial length that is approximately 25% to 35% of said axial length of said first liquid channel portion.

7. The apparatus of claim 1, wherein an external diameter of said gas tube in said region of said first gas tube portion is approximately equal to an internal diameter of at least one flow channel that surrounds said filling element axis to define one of a coil, and a swirl-creating body that has a relationship to said valve body selected from a group consisting of surrounding said valve body and being formed on said valve body.

8. An apparatus comprising a filling machine for filling containers with a liquid product, said filling machine comprising a revolving rotor operatively coupled to a plurality of filling elements, at least one of which has said limitations recited in claim 1.

9. An apparatus for pressure filling a container with a liquid charge, said apparatus comprising a filling element extending along filling-element and comprising a liquid channel formed in a filling element housing, said liquid channel comprising a connection for feeding said liquid charge into said liquid channel in a radially inward direction relative to said filling-element axis, and a discharge opening for discharging said liquid charge into said container, and a liquid valve arranged in said liquid channel for controlling discharge of said liquid charge into said container, said liquid valve comprising a valve body, a gas tube surrounded by said valve body, said gas tube acting as a valve plunger that can be moved in a controlled manner along said filling element axis to open and close said liquid valve, said gas tube being connected at a lower, open gas tube end thereof to an interior of said container during a filling process and comprising a partial length that extends through said liquid channel, a first gas tube portion adjacent to said valve body and that, over at least half its length runs in said liquid channel, said first gas tube portion having at least an enlarged internal cross-section that forms a gas channel portion having one of an enlarged flow cross-section and an enlarged volume, and wherein a flow cross-section in said gas channel portion is larger than a flow cross-section in a gas tube portion having said lower gas tube end and a flow cross-section in a further gas tube portion adjoining said first gas tube portion.

10. The apparatus of claim 9, wherein said gas tube comprises, on said first gas tube portion, an enlarged external cross-section that is substantially equal to an external cross-section of one of said valve body and a wall portion that delimits, in a radially inward direction relative to said filling element axis, a flow path surrounding said valve body, wherein said liquid channel forms, at least over a partial length extending in said direction of said filling element axis, a first liquid channel portion that surrounds said first gas tube portion to define one of an annular channel and a ring and that comprises a substantially constant flow cross-section, wherein said first liquid channel portion extends over at least 50% of one of said partial length of said liquid channel and said total length of said liquid channel.

11. The apparatus of claim 9, wherein said first gas tube portion comprises an enlarged internal and external cross-section.

* * * * *